US009464346B2

(12) United States Patent
Michalot et al.

(10) Patent No.: US 9,464,346 B2
(45) Date of Patent: Oct. 11, 2016

(54) METHOD FOR COOLING METAL PARTS HAVING UNDERGONE A NITRIDING/NITROCARBURISING TREATMENT IN A MOLTEN SALT BATH, UNIT FOR IMPLEMENTING SAID METHOD AND THE TREATED METAL PARTS

(75) Inventors: Bernard Michalot, Saint Just Saint Rambert (FR); Bernard Zabinski, Saint Just Saint Rampert (FR); Houcine Hadj Rabah, Saint Etienne (FR)

(73) Assignee: H.E.F., Andrezieux Boutheon (FR)

( * ) Notice: Subject to any disclaimer, the term of this patent is extended or adjusted under 35 U.S.C. 154(b) by 325 days.

(21) Appl. No.: 14/232,690

(22) PCT Filed: Jul. 12, 2012

(86) PCT No.: PCT/FR2012/051651
§ 371 (c)(1),
(2), (4) Date: Mar. 7, 2014

(87) PCT Pub. No.: WO2013/011228
PCT Pub. Date: Jan. 24, 2013

(65) Prior Publication Data

US 2014/0216608 A1 Aug. 7, 2014

(30) Foreign Application Priority Data

Jul. 15, 2011 (FR) ..... 11 56459

(51) Int. Cl.
*C23C 8/80* (2006.01)
*C23C 8/48* (2006.01)
*C23C 8/54* (2006.01)

(52) U.S. Cl.
CPC . *C23C 8/80* (2013.01); *C23C 8/48* (2013.01); *C23C 8/54* (2013.01)

(58) Field of Classification Search
CPC ..... C23C 8/80; C23C 8/48; C23C 8/54
See application file for complete search history.

(56) References Cited

U.S. PATENT DOCUMENTS 3,560,271 A 2/1971 Heinen
4,461,656 A * 7/1984 Ross ..... C21D 1/53 148/209
5,741,372 A * 4/1998 Gugel ..... C23C 12/02 148/276

FOREIGN PATENT DOCUMENTS

JP 7054038 A 2/1995

OTHER PUBLICATIONS

International Search Report for PCT/FR2012/051651 dated Sep. 25, 2012.

* cited by examiner

*Primary Examiner* — Veronica F Faison
(74) *Attorney, Agent, or Firm* — Heslin Rothenberg Farley & Mesiti P.C.

(57) ABSTRACT

Before the end of the treatment of metal parts in a molten salt bath nitriding/nitrocarburizing station, a chamber, arranged so that the oxygen contained in the chamber can be discharged in order to create an inert atmosphere, is filled with a refrigerant in liquid form and with a strong capacity for volume expansion as it evaporates. All the parts treated are transferred into the chamber. The chamber is closed, and the parts are left in the chamber for a preset length of time to reach a temperature at which the salt congeals and forms a protective barrier. The parts are then removed and subjected to a rinsing operation.

10 Claims, 6 Drawing Sheets

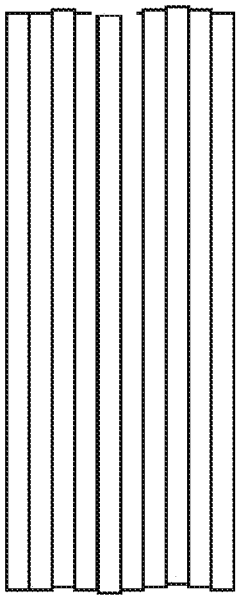
Fig. 5
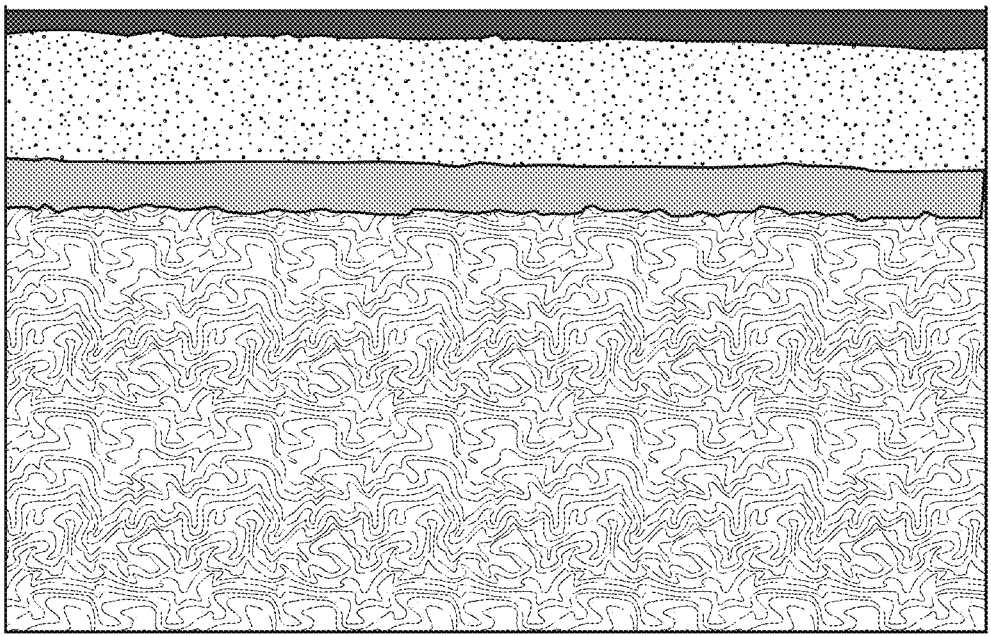

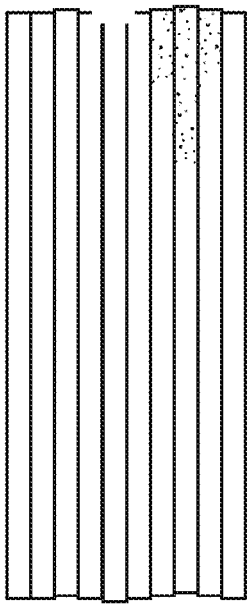
Fig. 6
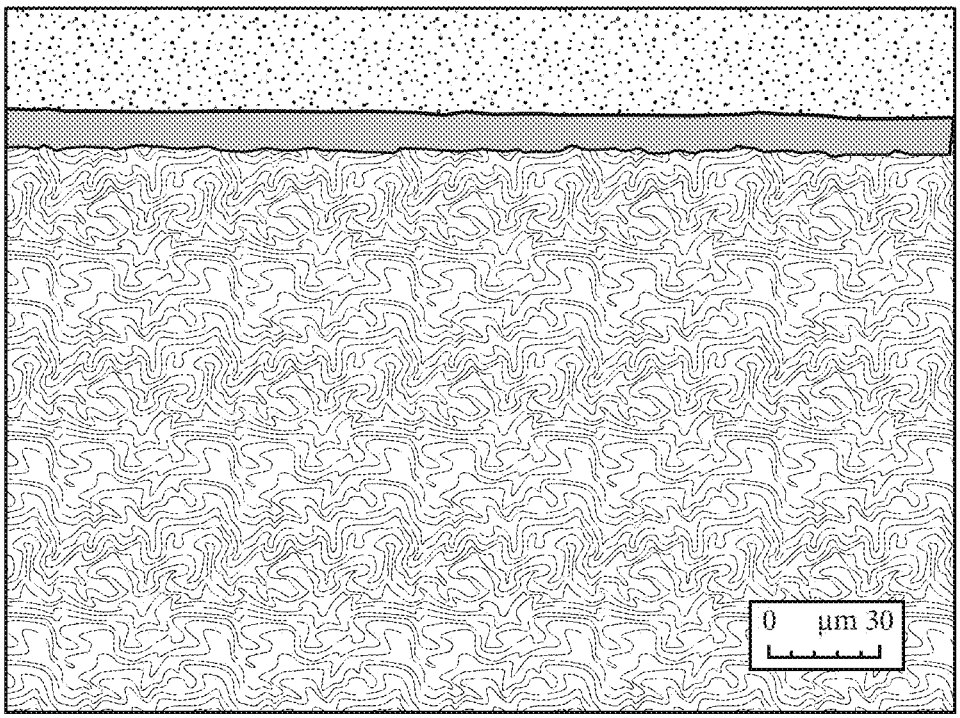

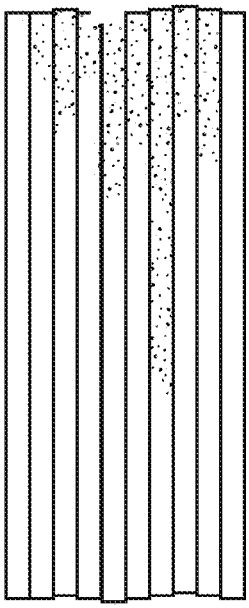
Fig. 7
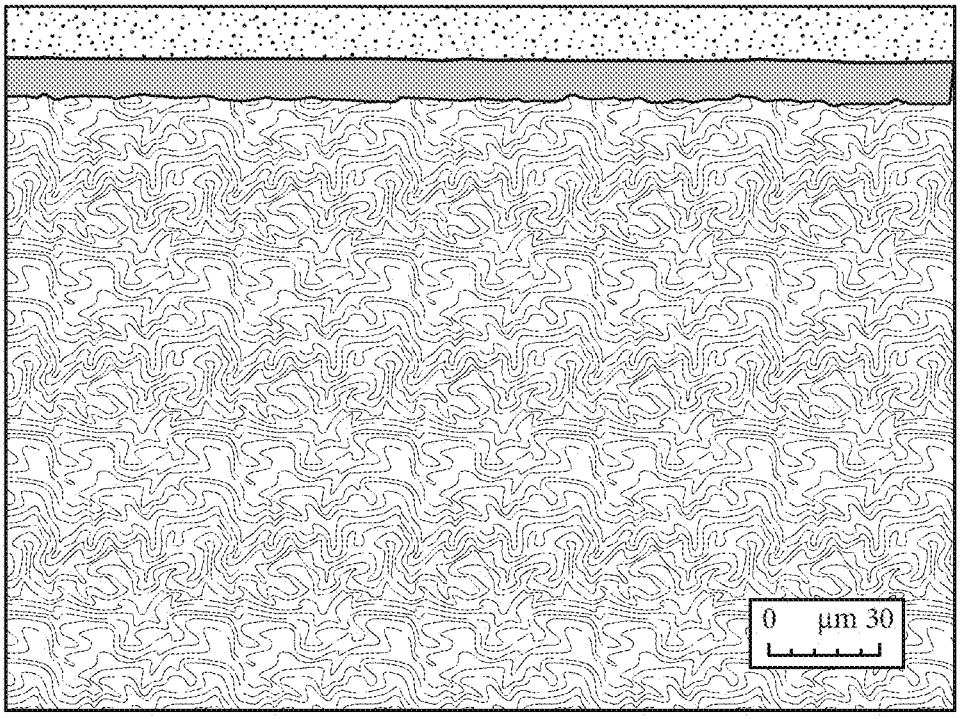

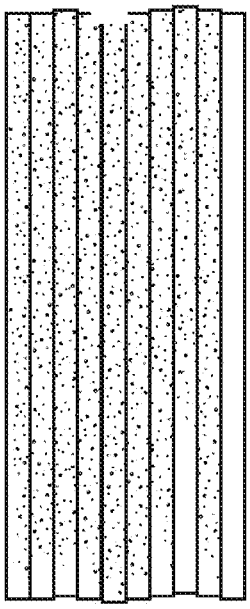
Fig. 8
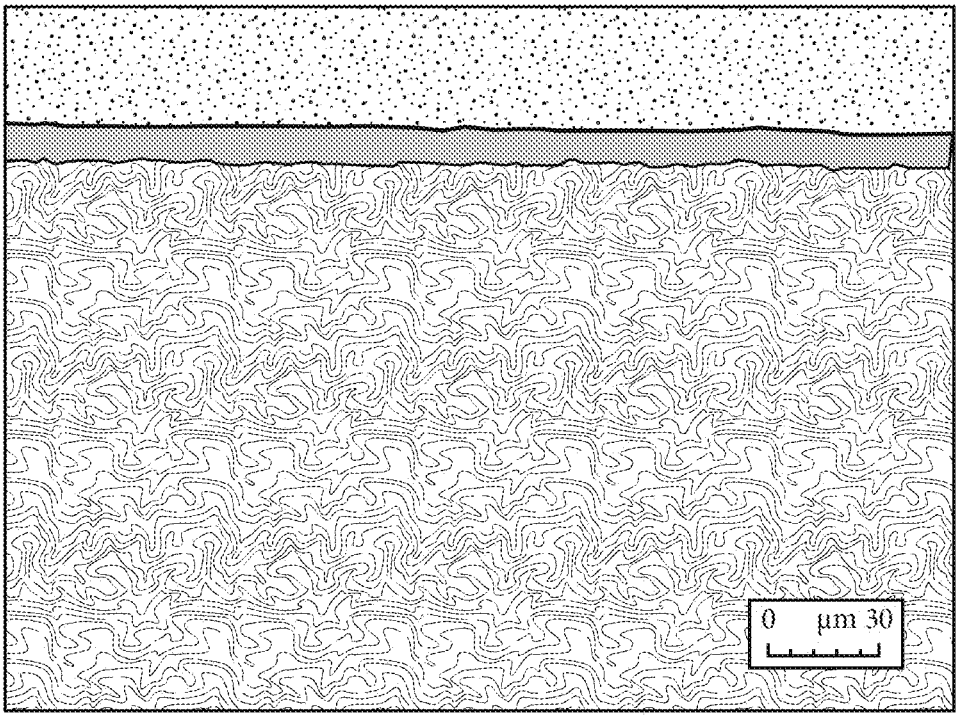

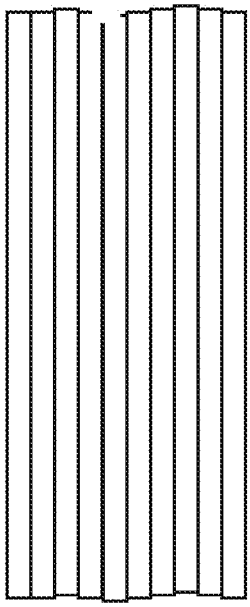
Fig. 9
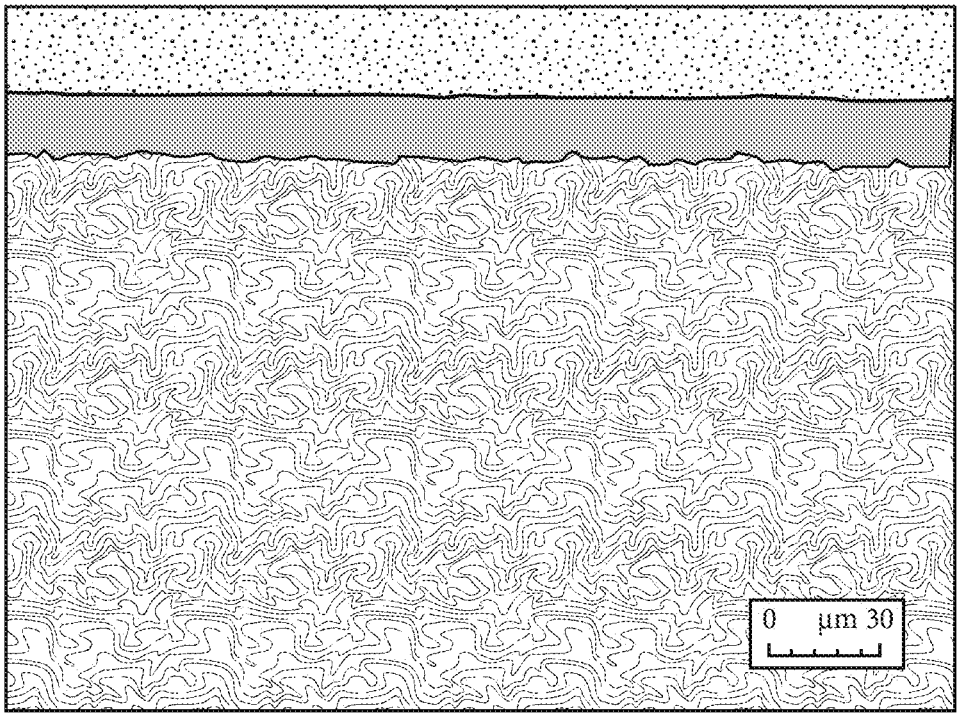

METHOD FOR COOLING METAL PARTS HAVING UNDERGONE A NITRIDING/NITROCARBURISING TREATMENT IN A MOLTEN SALT BATH, UNIT FOR IMPLEMENTING SAID METHOD AND THE TREATED METAL PARTS

CROSS REFERENCE TO RELATED APPLICATIONS

This application is a national stage filing under section 371 of International Application No. PCT/FR2012/051651 filed on Jul. 12, 2012, and published in French on Jan. 24, 2013 as WO 2013/011228 A1 and claims priority of French application No. 1156459 filed on Jul. 15, 2011, the entire disclosure of these applications being hereby incorporated herein by reference.

BACKGROUND ART

The invention relates to a method and a facility for cooling metal parts that have been subjected to a molten salt bath nitriding/nitrocarburizing treatment. The invention also relates to the parts so treated.

The use of methods that employ a thermochemical diffusion of nitrogen by nitriding or nitrocarburizing in baths of molten salts to reduce the coefficient of friction and improve the adhesive and abrasive wear resistance of metal parts is fully understood by those skilled in the art. In the main, these salt baths generally comprise cyanate and alkaline carbonate. When the nitriding temperature is reached, the alkaline cyanate releases nitrogen and carbon which diffuse over the surface of the part. The treatment times are generally between 20 and 180 mn at temperatures of between 400 and 700° C. These industrially used processes are known for example under the brand names SURSULF or TENIFER.

It will be remembered that a nitriding/nitrocarburizing treatment process comprises the following main steps:

degreasing the parts,
preheating,
nitrocarburizing treatment,
cooling,
rinsing,
drying.

When ferrous alloys are concerned, this treatment generally causes two characteristic zones to form: a first surface zone, with a thickness of between 5 and 30 μm consisting mainly of ϵ nitrides (Fe2-3n) and γ' nitrides (Fe4N), known as the compound zone, followed by a second zone, with a thickness generally of between 0.2 and 1.5 mm characterized by the presence of nitrogen in solid solution in the iron grains and in the form of nitrides of alloying elements, known as the diffusion layer.

Various alternative methods of cooling after the nitrocarburizing treatment have been developed in order to improve some features of the treated parts:

an improvement in the corrosion resistance of the treated parts is obtained by replacing water quench cooling by an oxidizing salt bath quench (380-420° C.). Treatment of this kind, known for example under the brand names Arcor® or AB1®, produces a black iron oxide (Fe3O4) on the treated surface.

a reduction in the brittleness, or an improvement in the ductility of the parts treated, is obtained by replacing water quench cooling by cooling that is slower such as oil cooling or slower still air cooling. Slow cooling is also recommended for parts that cannot withstand significant distortion. The parts obtained are characterized by the presence of iron nitride precipitates □'-$Fe_4N$ and α"-$Fe_{16}N_2$, parallel to the grain boundaries in the diffusion layer. The precipitation is related to the decrease in the solubility limit of nitrogen in iron with the temperature.

For an industrial treatment of parts, the latter are placed in a metal rack to facilitate the transportation thereof, using robots for example, between the various treatment stations. For reasons of productivity, the fill factor of the rack is at maximum, so that the parts are able to be in contact with each other. The parts are transferred from the nitriding bath to the cooling zone for a length of time such that, in contact with the ambient air, oxidation or surface discolouration spots appear on the surface of a more or less significant portion of the treated parts. Tests carried out in the laboratory have shown that after a transfer time of more than about 30 seconds, oxidation spots are seen to appear on some parts only, whereas after a transfer time of some 120 seconds, all the parts are oxidized. As it happens, the industrial transfer time between two successive treatment zones is generally between these two values.

It should also be noted that air cooling inevitably induces a surface oxidation of the parts.

It is quite obvious that the presence of these oxidation spots is not acceptable for some applications. Not only are these spots detrimental to the appearance of the parts, but also to their use, particularly for applications that are exacting in terms of surface cleanness. Indeed, the oxidized zones generate dust which may, when lubricants are present, create aggregates, and bring about abrasive wear that is harmful for the intended application.

In the current state of the art, the industrial solutions proposed cannot ensure a molten salt bath nitriding/nitrocarburizing treatment that has a sufficiently high degree of cleanness and is of good enough appearance, in other words with no trace of oxidation on any of the parts treated.

In this respect, it should be recalled that the technical field of the invention relates to an industrial treatment of parts which cannot be compared with a nitriding/nitrocarburizing treatment performed at laboratory level where the parts are only treated in small quantities. As a result, in the laboratory, after the nitriding bath, the parts are able to be transferred quickly enough to avoid oxidation during water cooling for example.

It will be understood that this is not possible on an industrial scale, when a large number of parts is to be treated simultaneously, thereby generating a significant rejection rate. Even by reducing the part transfer time as much as possible, particularly between the treatment zone and the cooling zone, it then proves necessary to conduct a visual inspection and a unit sort out of the parts if the absence of oxidation traces is to be guaranteed.

U.S. Pat. No. 3,560,271 relates to a method of nitriding in baths of molten salts with the aim of slowing down cooling after nitriding so as to reduce the working stress levels in order thereby to limit the risk of the layer cracking Vacuum cooling can only occur through radiation, thereby giving cooling times that are not easily compatible with an industrial process (from several hours to several tens of hours).

Moreover, the use of said process does not ensure the complete absence of any trace of oxidation when treating a large number of parts which requires relatively high transfer times between the treatment station and the cooling station (i.e when transferring the loads, mass inertia compels part load stabilization phases after deceleration particularly during horizontal transfers, and therefore minimum transfer times).

It is clear therefore from an analysis of the prior art that the industrial solutions in use cannot ensure a molten salt bath nitriding/nitrocarburizing treatment that has a sufficiently high degree of cleanness and is of good enough appearance, in other words, with no trace of oxidation on any one portion or on any of the parts treated.

It will also be understood that it is not possible, especially where an industrial treatment is concerned, to obtain parts that are sufficiently ductile while at the same time showing no trace of oxidation.

The purpose set by the invention is to overcome these drawbacks in a straightforward, safe, efficient and rational manner.

The problem the invention therefore sets out to resolve is that of ensuring, in respect of an industrial treatment of metal parts that have been subjected to a molten salt bath nitriding/nitrocarburizing treatment, that there are no traces of oxidation-corrosion, so that the ductility thereof can be improved.

BRIEF SUMMARY OF THE INVENTION

To resolve this problem, a method has been devised and perfected for cooling metal parts that have been subjected to a molten salt bath nitriding/nitrocarburizing treatment, according to which:

- before the end of said treatment, a chamber, arranged so that the oxygen contained in said enclosure can be discharged in order to create an inert atmosphere, is filled with refrigerant, in liquid form and with a strong capacity for volume expansion as it evaporates,
- all the treated parts are transferred into the chamber,
- the chamber is closed,
- the parts are left in the chamber for a preset length of time to reach a temperature at which the salt congeals and forms a protective barrier,
- the parts are removed and subjected to a rinsing operation.

To advantage, the refrigerant is liquid nitrogen which will evaporate very quickly due to the heat of the bath and of the parts. Said evaporation will produce a volume of gas about 630 times greater, which will very quickly discharge the oxygen found inside the chamber. The result is a cooling that is slow in the metallurgical sense of the term, but fast enough to be compatible with an industrial process, of the parts in an inert atmosphere, ensuring that they have a degree of ductility with no risk of oxidation spots appearing and consequently no danger of subsequent dust emissions.

According to another feature, the chamber is filled with liquid nitrogen, 2 to 3 minutes before the end of the nitriding/nitrocarburizing treatment. At the end of the nitriding/nitrocarburizing treatment the parts are transferred vertically to the chamber filled with liquid nitrogen at a minimum rate of 6 m/mn. After cooling to a temperature of about 350° C., they are rinsed in water at a temperature of between 40 and 50° C., and then in water at a temperature of between 15 and 25° C.

To implement the method, the cooling chamber is placed in direct relation with the nitriding/nitrocarburizing station while being secured to a transfer carriage for a quick transfer of all the parts into said chamber.

To resolve the problem posed of obtaining a slow cooling of the parts and an extremely rapid nitrogen saturation of the inside of the chamber, without having to resort to pre-pumping systems to drive out the air initially present, the chamber consists of a double-walled bell into which the liquid nitrogen is injected, said double wall having arrangements for diffusing the nitrogen inside the bell.

According to other features, the base of the bell engages with means capable of giving free access to the inside of said bell for the transfer of parts, and of closing this access during the cooling phase. The means consist of doors secured to one portion of the treatment station.

The invention also relates to the parts that have been subjected to a molten salt bath nitriding/nitrocarburizing treatment, according to the features of the method claimed. More generally, the invention relates to metal parts in respect of which no oxidation spots can be seen and nitride precipitate is present in the diffusion zone

BRIEF DESCRIPTION OF THE DRAWING FIGURES

The invention is disclosed hereinafter in further detail with the help of the appended drawings wherein:

FIGS. 5, 6, 7, 8 and 9 show a sample of parts after a 60-minute treatment in a SURSULF nitrocarburizing bath (CN—: 4.15%; CNO—30.5%) at 580° C. and cooled according to the prior art and in different conditions (FIGS. 5, 6, 7 and 8) and according to the invention, i.e. in liquid nitrogen (FIG. 9); with each sample is associated the corresponding micro-section.

DETAILED DESCRIPTION

The facility for the molten salt bath nitriding/nitrocarburizing of metal parts is not described in detail since it is fully understood by those skilled in the art, even though able to be found in various alternative implementations.

The facility is adapted to treat the parts on an industrial basis i.e. not separately, but in batches, for example by placing said parts in a metal rack in order to facilitate the transfer thereof by robots between the various treatment stations.

According to the invention, a cooling chamber (1) is placed in direct relation with the nitriding/nitrocarburizing station while being secured to a transfer carriage for a fast transfer of all the parts under consideration (P) into said chamber (1). As indicated, the parts (P) are placed in a rack (R) for example.

According to one significant feature of the invention, the chamber (1) consists of a double-walled bell (1*a*) into which liquid nitrogen is injected. This double wall (1*a*) has arrangements for diffusing the liquid nitrogen inside the bell (1). For example, the double wall (1*a*) has baffles (1*b*) for diffusing the liquid nitrogen through calibrated orifices (1*c*). The liquid nitrogen is supplied via any known appropriate means (2). The bell (1) is secured to the transfer carriage. The bell aperture, located at the lower end thereof, engages with doors (3) and (4) secured to the nitrocarburizing station.

Figure 1:
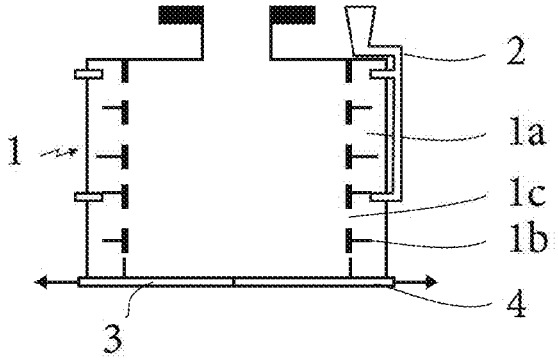
FIG. 1 is a diagrammatic cross-section view of the bell-shaped chamber according to the features of the invention.
Figure 2:
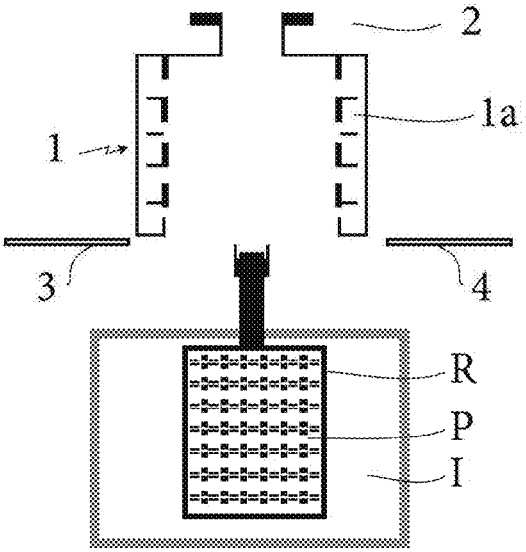
FIGS. 2, 3 and 4 are diagrammatic views showing main phases of the treatment method according to the features of the invention.
Figure 3:
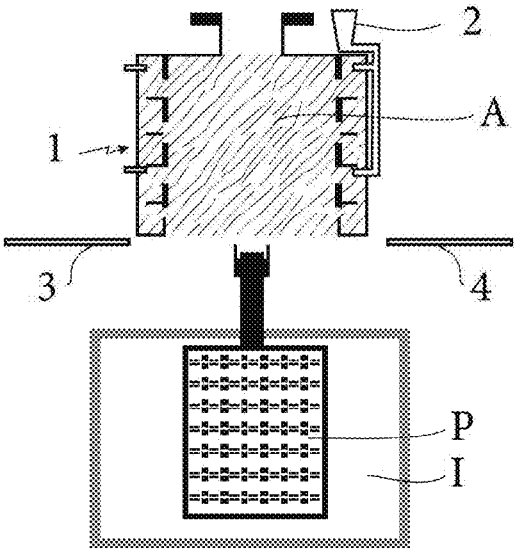
Figure 4:
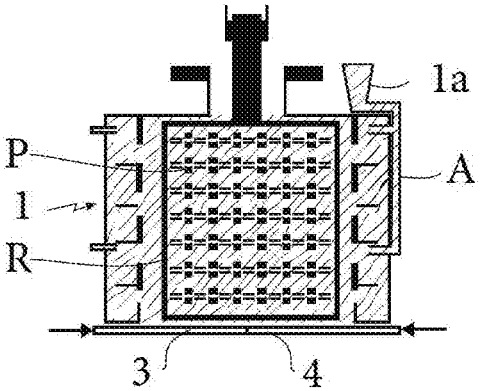

Reference should be made to FIGS. 2, 3 and 4 which show the main phases of the method forming the basic features of the invention. The nitrocarburizing treatment as such may for example be of the type known under the brand name SURSULF, TENIFER etc. The length of the treatment is generally between 20 and 180 mn and is typically between about 50 and 60 minutes. The bell (1) is placed over the bath (I) in which all the parts (P) placed in the rack (R) are quenched. The doors (3) and (4) are open (FIG. 2).

A few minutes, between 2 and 3 approximately, before the end of the nitrocarburizing process, liquid nitrogen (A) is injected through the double wall (1*a*) as previously indicated, in order to discharge very quickly the oxygen found inside the bell (1) in order to provide the parts (P) with a metallurgically slow cooling in an inert atmosphere (FIG. 3).

In FIG. 4, all the parts (P) are transferred inside the bell (1) filled with liquid nitrogen (A). The transfer is performed at a fast rate of about 6 m/mn. The doors (3) and (4) are then closed so that the cooling operation as such can take place. Depending on the part mass, cooling occurs for a set period of time in order to reach about 350° C. in the absence of oxygen, noting that, above this temperature, there is no further oxidation. This period of time is typically less than or substantially equal to the part nitriding or nitrocarburizing treatment time.

It should be noted that the rate of 6 m/mn depends on the distance between the level of the nitriding bath and the input into the bell; this rate may therefore be faster or slower depending on circumstances: the faster the rate, the more accurate the results will be.

After this cooling, all the parts are rinsed, said rinsing being carried out in water brought to a temperature of 40 to 50° C., and then in water brought to a temperature of about 20° C.

Reference should be made to FIGS. 5, 6, 7, 8, and 9 which show the results obtained in respect of parts treated using prior art solutions, in FIGS. 5 to 8, and in accordance with the invention, in FIG. 9.

In FIGS. 5, 6, 7, and 8, the cooling is carried out according to the prior art by quenching the parts in water either immediately after the nitriding/nitrocarburizing treatment (impossible in industrial conditions), as in FIG. 5, or after a more or less lengthy period of time after the treatment, namely 30 seconds after the treatment (FIG. 6), 60 seconds after the treatment (FIG. 7) and 120 seconds after the treatment (FIG. 8).

The absence of oxidation spots on the parts and an absence of nitride precipitates in the diffusion layer can be seen in FIG. 5. The appearance of oxidation spots (brownish spots) and above all a marked increase in the number of oxidized zones with the increase in time between leaving the bath and quenching in water can be seen in FIGS. 6, 7 and 8.

In parallel with the appearance of these oxidized zones the micro-sections show the appearance of a growing number of iron oxide precipitates, parallel to the plane of the grain boundaries. Said appearance is characteristic of slow cooling and is related to the decrease in the solubility limit of nitrogen with the temperature.

It is therefore clear from the experiments conducted in the conditions as in FIGS. 6, 7 and 8 that cooling by water after nitriding/nitrocarburizing does not give, on an industrial basis, clean ductile parts, i.e. with no trace of oxidation and with the presence of nitride precipitates in the diffusion zone.

According to the invention, cooling in liquid nitrogen, as in FIG. 9, clearly shows the absence of surface oxidation traces and the presence of nitride precipitates, with consequently improved mechanical properties.

Reference should be made to the table below which shows the hardness reading (Rq: roughness reading is of no help) in respect of parts after 60 minutes treatment in a nitrocarburizing bath (CN—: 4.15%; CNO—30.5%) at 580° C., according to the test conditions instituted and shown in FIGS. 5 to 9 i.e. cooling by water quenching immediately after leaving the treatment bath (column A), water quenching 30 seconds after leaving the treatment bath (column B), water quenching 60 seconds after treatment (column C), water quenching 120 seconds after treatment (column D), and cooling in liquid nitrogen (column E).

| | A | B | C | D | E |
|---|---|---|---|---|---|
| Hardness (Hv0.1) at 20 μm under compound layer | 295 | 265 | 230 | 170 | 190 |

The advantages are clear from the description, and it is particularly important to stress and remember:

- relative to water cooling, the inventive method improves the ductility of the parts and limits the risk of distortion through slow cooling.
- relative to air or water cooling where an industrial process is concerned, the inventive method guarantees a correct appearance of the parts resulting from an absence of traces of corrosion after treatment, thereby improving their state of cleanness.

The invention claimed is:

1. A method of cooling metal parts that have been subjected to a molten salt bath nitriding/nitrocarburizing treatment in a treatment station, comprising:

arranging a cooling chamber in direct overlying relation with the treatment station, before an end of said treatment, filling the cooling chamber, With refrigerant in liquid form, volume expansion as the refrigerant evaporates discharging oxygen from the cooling chamber to create an inert atmosphere within the cooling chamber, transferring vertically all the treated parts from the treatment station directly into the inert atmosphere within the cooling chamber, closing the chamber, leaving the parts in the chamber for a preset length of time to reach a temperature at which salt congeals and forms a protective barrier, and removing the parts from the chamber and then subjecting the parts to a rinsing operation, whereby the cooling method results in parts exhibiting no trace of surface oxidation.

2. The method as claimed in claim 1, wherein the refrigerant comprises liquid nitrogen.

3. The method as claimed in claim 2, wherein the filling the chamber comprises filling with liquid nitrogen, 2 to 3 minutes before the end of the nitriding/nitrocarburizing treatment.

4. The method as claimed in claim 2, wherein the parts are transferred from the chamber filled with liquid nitrogen at a minimum rate of 6 m/minute.

5. The method as claimed in claim 1, wherein the rinsing is performed in water at a temperature of between 40 and 50° C., and then in water at a temperature of about 20° C.

6. A facility for implementing the method as claimed in claim 1, comprising a molten salt bath nitriding/nitrocarburizing treatment station for treatment of a set of parts and a cooling chamber placed in direct overlying relation with the nitriding/nitrocarburizing station while being secured to a transfer carriage for a quick direct vertical transfer of all the parts into said chamber.

7. The facility as claimed in claim 6, wherein the chamber comprises a bell with a double-wall into which liquid nitrogen is injected, said double wall having arrangements for diffusing the nitrogen inside the bell.

8. The facility as claimed in claim 7, wherein a base of the bell engages with means for giving free access to an inside of said bell for the direct vertical transfer of the set of parts into the cooling chamber, and for closing said access during a cooling phase.

9. The facility as claimed in claim 8, wherein the means comprises doors secured to one portion of the treatment station.

10. Metal parts treated according to the method as claimed in claim 1.

* * * * *